US005078327A

United States Patent [19]

Kemetter

[11] Patent Number: 5,078,327

[45] Date of Patent: Jan. 7, 1992

[54] DEVICE FOR THE PROCESSING OF MATERIALS

[76] Inventor: Georg L. Kemetter, Marviksv. 20B, SF-00930 Helsinki, Finland

[21] Appl. No.: 455,445

[22] PCT Filed: May 11, 1988

[86] PCT No.: PCT/AT88/00029

§ 371 Date: Nov. 20, 1989

§ 102(e) Date: Nov. 20, 1989

[87] PCT Pub. No.: WO88/09211

PCT Pub. Date: Dec. 1, 1988

[30] Foreign Application Priority Data

May 19, 1987 [AT] Austria ..... 1277/87

[51] Int. Cl.[5] ..... B02C 1/00

[52] U.S. Cl. ..... 241/36; 241/37; 241/66; 241/84.3; 241/102; 241/148; 241/166; 241/266

[58] Field of Search ..... 241/296, 66, 84.3, 94, 241/166, 36, 148, 202, 264–269, 219, 67, DIG. 30, 37, 102

[56] References Cited

U.S. PATENT DOCUMENTS

| | | | |
|---|---|---|---|
| 591,891 | 10/1897 | Skinner et al. | 241/266 X |
| 1,512,466 | 10/1924 | Iff . | |
| 1,767,353 | 6/1930 | Dorlodot | 241/DIG. 30 X |
| 1,906,792 | 5/1933 | Gwillim . | |
| 2,123,827 | 7/1938 | Eyrick et al. | 241/266 X |
| 2,772,053 | 11/1956 | Schmidtmann | 241/266 X |
| 4,749,132 | 6/1988 | Hagiwara et al. | 241/37 X |

FOREIGN PATENT DOCUMENTS

| | | | |
|---|---|---|---|
| 730211 | 1/1943 | Fed. Rep. of Germany . | |
| 49133 | 3/1889 | Fed. Rep. of Germany . | |
| 1066842 | 10/1959 | Fed. Rep. of Germany | 241/66 |
| 1109986 | 6/1961 | Fed. Rep. of Germany | 241/265 |
| 2420913 | 11/1975 | Fed. Rep. of Germany . | |
| 2758042 | 6/1979 | Fed. Rep. of Germany . | |
| 2569996 | 3/1986 | France . | |
| 2598098 | 11/1987 | France . | |
| WO/8303062 | 9/1983 | PCT Int'l Appl. . | |
| 300850 | 8/1954 | Switzerland . | |
| 98330 | 1/1983 | U.S.S.R. | 241/266 |
| 26206 | 12/1908 | United Kingdom | 241/266 |
| 2040506 | 8/1980 | United Kingdom . | |
| 2117268 | 10/1983 | United Kingdom . | |

*Primary Examiner*—Mark Rosenbaum
*Attorney, Agent, or Firm*—Salter & Michaelson

[57] ABSTRACT

A device for processing materials such as rock, ore, clay, bulk materials and agglomerated pulverized materials includes at least two tools having working surfaces thereon of at least partially circular cylindrical cross section. The tools are oriented such that the working surfaces thereof are in opposed horizontally spaced relation, and the device includes a mechanism for moving at least one of the tools with an up and down pendulum motion about the respective axis thereof. The tools include upper surface portions and lower surface portions, and the upper surface portion of at least one of the tools has a plurality of comminuting projections thereon for preprocessing relatively large sized materials. The lower surface portions of the tools are substantially smooth, and they are positioned in closely spaced relation for processing materials therebetween to form a finely milled and product.

17 Claims, 2 Drawing Sheets

DEVICE FOR THE PROCESSING OF MATERIALS

The invention relates to a device for the processing of materials such as rock, ore, clay, bulk materials, agglomerated pulverized materials and the like, comprising at least two tools having surfaces of at least partially circular cylindrical cross sections supported on substantially horizontal axles arranged in the circular arc centers and movable by means of preferably hydraulic driving means in such a manner that at least one of the tools carries out an upward and downward pendulum motion about its axle, the space on top between the two opposing circular cylindrical surfaces of the two tools forming a feeder wedge for the material to be processed and the circular cylindrical surface of at least one of the tools being provided with projecting comminuting means.

A device of this type for the comminution of bulky waste is known from DE-A-27 58042 and GB-A-2 117 268.

GB-A-2 117 268 describes a comminuting device for a raw material consisting of loam for the production of bricks provided with two semicylindrical tools having substantially horizontal axles whose curved surfaces are juxtaposed and form a gap into which the material to be comminuted is fed via a chute. One of the two tools is fixedly arranged and provided with a smooth surface, while the other one of the two tools carries out an upward and downward pendulum motion about its axle and is provided on its entire surface with comminuting means, partially in the form of jags projecting from the surface and partially in the form of cylindrical trunnions projecting from the surface. Of disadvantage in the known device is the fact that the communition of the raw material introduced can be carried out only to a certain extent, as the gap between the circular cylindrical surfaces of the two tools can be reduced only to the extent to which the comminuting means projecting from the surface of the tool carrying out the pendulum motion do not touch the surface of the other, stationary tool. The raw material can therefore pass the gap between adjacent comminuting means without being comminuted.

Up to now, hard rock has mainly been precrushed by means of jaw crushers, while fine crushing or grinding was done by means of cone crushers or rotary crushers. Thus by means of tools exerting a squeezing and pressing effect on the rock material, as in this type of tools, the expenditure for labor and wearing parts has been comparatively low. But the extent of crushing achieved by means of these tools has also been low. For comminuting comparatively soft materials such as, for instance, limestone without silicate inclusions, high-speed rebound crushers and hammer mills which show a substantially improved degree of communition in one operation in comparison to the previously mentioned jaw crushers, cone crushers and hammer mills, are successfully used, although the wear rates of these devices increase so drastically from a certain degree of hardness of the material on that the advantages obtained are obviated by an unreasonably high expenditures for maintenance and wearing parts.

So, for instance, brickyards normally use various perforated plate systems for the filtering of clay, i.e. for removing rock, wood and iron scraps and other foreign matter from the clay prior to processing it into bricks. The clay is pressed through the filter of a system of this type pressure by means of screw conveyors, the foreign matter is retained on the screw side and separated by various methods. Another process provides for the clay to be charged between two rotating perforated roller shells, the clean clay passing through the perforations into the interior of the roller shells and being stripped from there, while the foreign matter is either crushed between the rollers so that it then also passes the perforations or forces the resiliently supported one of the two rollers to yield due to its excessive hardness. In this case, the gap between the rollers opens briefly and the foreign matter drops through it to be discharged. If the portion of foreign matter in the clay is large, much good clay is lost in this method each time the roller gap opens.

One feature common to all processes using screw conveyors is that the screws are subject to extreme wear.

On sifting moist, pulverized materials with a certain humidity content, there is the problem of the screen orifices becoming clogged and particular measures having to be taken to clean these orifices and keep them open, as these materials could not be sifted otherwise.

In dressing rock, there are cases in which materials of higher and lower crushing strength must be separated and graded. If these materials are of different colors, it is known to use color-controlled grading devices, although their effectiveness is unsatisfactory, so that rock still has to be graded manually today.

DE-OS 24 20 913 describes a crushing unit mainly used for the flotation of granular plastics such as thermoplastic foil, blow-molded parts, scrap tires, glass and the like. This known crushing unit has two substantially horizontal axles on which knives of partially circular arcuate cross section are supported which carry out a reciprocating motion. The cutting edges of the knives supported on one of the two axles engage the gap between adjacent knives supported on the other one of the two axles. The cutting edges are either smooth or serrated in their lower portion. This known crushing unit does not permit the crushing of the materials mentioned above in the required manner without subjecting them to pressure and no precrushing of these materials in the feeding wedge is provided.

It is the object of the present invention to provide a device for the processing of materials, in particular for crushing rock and ore, for the filtering of clay or similar materials, for the sifting of pulverized materials of a certain humidity content or agglomerated and for the grading of rock material or the like, which is thoroughly effective at comparatively simple construction and low wear. In order to achieve this object, the invention provides, based on a device of the type initially described, for the circular cylindrical surface of at least one of the tools to be provided with projecting teeth, cams, ledges or the like only in its upper portion and to be formed smooth, i.e. without any protruding projections, in its lower portion in which the two tools are opposed during their motion.

By means of the teeth, cams, ledges or the like provided in the upper portion of the cylindrical surface of the tools, the materials to be processed are crushed to such an extent that their processing, in particular their complete comminution, can be effected as they are passed through the nip between the smoothly formed lower portions of the cylindrical surfaces of the tools merely by pressure and mastication. Due to the fact that at least one of the tools carries out an oscillating rotational motion about its axle, those particles of the material which are not crushed to the required size for processing in the lower portion are returned and reshifted and thus exposed to another layer of teeth, cams, ledges or the like so that they are subjected to a further precrushing operation until these particles are also of the required size for processing. The particles which cannot be precomminuted to the required size can be discharged, as explained in detail in the following.

If the device according to the invention is used for the comminution of materials, the degree of comminution in one operation is substantially increased in comparison to the known processes, so that the intended processing can normally be effected with a lower number of apparatus arranged in series.

If, for instance, clay material or a similar material is to be filtered, the invention provides for a filter plate provided with orifices to be disposed on the lower portion of the circular cylindrical surface of at least one of the tools. The material precrushed by the teeth, cams, ledges or the like is in this case forced through the filter plate and thus filtered.

If agglomerated bulk material or bulk material with a certain moisture content is to be sifted, the invention provides for a screen to be disposed on the lower portion of the cylindrical surface of at least one of the tools. The lumps and conglomerates present in the bulk material are precomminuted by means of the teeth, cams, ledges or the like in this way so that proper sifting is obtained. In many cases, this makes the sifting of bulk material with a certain moisture content possible even without predrying.

In this case, the feeder wedge is conveniently provided with a preferably rotating or oscillating cleaning brush cooperating with the screen and preventing the clogging of the screen orifices.

The lower portion of the cylindrical part of the opposing tool is conveniently formed elastically yielding, regardless of whether the lower portion of the other tool having a cylindrical surface is formed as a filter plate or a screen. In this case, foreign matter which cannot pass the perforations of the filter plate or of the screen is forced downwards and sorted out due to the elastically yielding configuration of the tool without the gap between the two tools having to widen, so that the material feed to the device according to the invention can be continuous and stopping of the device for removing the foreign matter is not necessary. Moreover, this configuration prevents damaging of the filter plate or the screen and the wear of these parts is thus substantially reduced.

According to a further feature of the invention, this tool may consist of a tube filled with compressed air, for instance a vehicle tire, in order to form it elastically yielding.

The teeth, cams, ledges or the like protruding from the cylindrical surface are conveniently adjustable, preferably hydraulically, and/or arranged changeable in their position in relation to the cylindrical surface. This conformation has the advantage that the position of the teeth, cams, ledges or the like can be adjusted to the material to be processed, so that for instance, the setting angle (angle of attack) of these parts can be changed as a function of the particle size distribution of the material to be processed, but above all that in the event of wear of these parts, the original state, in particular the original space between the parts of the cooperating tools, can be restored by this adjustment, so that replacement of these parts is only required after long periods of use.

According to the invention, the teeth, cams, ledges or the like protruding from the cylindrical surface can be releasably attached so that they are easily replaceable in case of wear.

In order to achieve the intended effect, it is not mandatory for the two tools to describe an upward and downward pendulum motion, i.e. an oscillating rotational motion. A structural simplification of the device according to the invention is possible by providing that only one of the tools carries out an upward and downward pendulum motion about the bearing axle, while the other tool merely carries out a rotating motion.

According to the invention, at least one of the two tools can be movingly supported on the bearing axle in addition to its pendulum or rotating motion about this bearing axle. This produces a sort of grinding effect by which the processing of the materials and the cubicity of the product can be decisively improved.

According to a further feature of the invention, at least one of the two tools is displaceably supported in its direction to the other tool, so that the space between the cylindrical surfaces of the two tools is changeable. By increasing this space, the device can be used for grading operations if larger and harder material inclusions whose processing is not possible at pressures for which the device according to the invention is suitable are conveyed into this space.

An adjustment to the composition or quality of the material changing during the processing operation is conveniently achieved by computer control of the size of the space between the two tools, the relative velocity of the tools, their rhythm and distance covered as well as their running in the same or opposing directions, as a function of pressure acting between the two tools and/or control by the power derived from the drive of the tools. If, for instance, maximum pressure is adjusted by the computer control, this causes the gap between the two tools to widen if harder materials pass into this gap which are then, for instance if the device according to the invention is used for grading or the crushing of rock, passed through the gap and subsequently easily discharged. If the pressure is lowered, the gap narrows automatically. The computer control permits not only the control of the size of the gap between the two tools, but also the fully automatic adjustment of the speed with which the two tools move, their rhythm, the distance covered, running of the tools in the same or opposing directions, to the respective operating conditions.

The control can also be achieved by the power derived from the drive of the tools instead of the pressure. Pressure and power are easily detectable by means of a measuring device to be input into the computer control.

Particularly if the device according to the invention is used for the sifting of moist materials, it is convenient to provide for at least one of the tools, above all the one whose lower portion is formed as a screen, to be heatable. This also prevents a clogging of the screen orifices, as the material is dried by heating in the area of these orifices. Moveover, heating of the grinding surfaces permits the contact drying of the materials to be processed.

A structurally convenient embodiment of the invention is obtained by providing a plurality of tools cooperating in pairs, with two tools of adjacent pairs being interconnected by means of an arm supported on a substantially horizontal axle arranged in the coinciding circular arc center of the surface of the tools of circular cylindrical cross section. This makes it possible to assemble several tools in a small space in such a manner that when one of the tools of a pair of tools moves downwards, the tool of the adjacent pair of tools connected to it via the arm moves upwards. This simplifies the structure of the drive of the two tools and reduces energy consumption. Moreover, this embodiment facilitates maintenance and the fast exchange of replacement units.

The invention is schematically explained in the following by means of exemplary embodiments.

Figure 1:
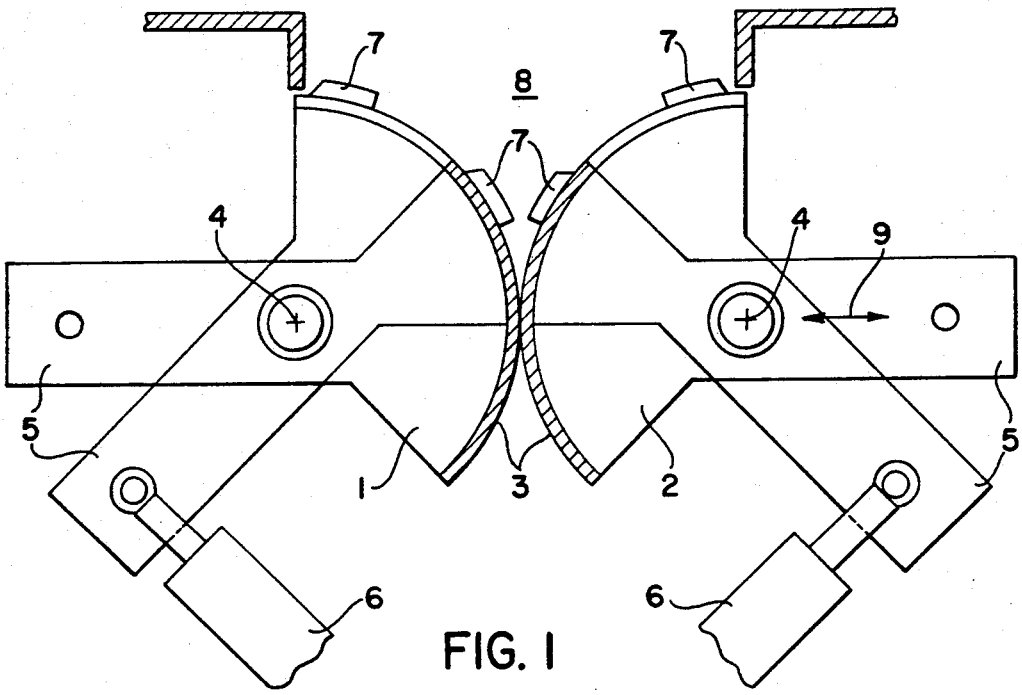
FIG. 1 shows a device for crushing rock according to the invention in elevational view, with the housing omitted.

The device shown in FIG. 1 is provided with two tools 1,2 whose mutually facing surfaces 3 are of circular cylindrical shape. These tools 1,2 are supported on axles 4 extending in the cylinder axis. Each one of the two tools is connected to a lug 5, each lug being subjected to the action of a hydraulically actuable piston-cylinder assembly causing an upward and downward pendulum motion of the two tools about the axles 4. The relative motion of the two tools can be different, the two tools may move with the same speed and in the same direction upwards and downwards, but the motion can also be effected at different speeds, one of the tools can stand still, for instance during the replacement of wearing parts on the outside, which means that the device continues to operate during this stage at reduced output, and finally, a movement of the two tools in opposing directions is also possible.

The movement of the tools 1,2 is preferably controlled by means of computer control which changes the course of motion of the two tools as a function of an actuating variable, for instance the pressure, the driving power derived or the size and/or shape of the particles of the material to be processed. This computer control thus automatically controls the gap between the two tools, the relative speed of the tools and their movement in the same or opposing directions. The actuating variable can e.g. be the pressure in the piston-cylinder assembly 6.

The circular cylindrical surface 3 of the two tools 1,2 is formed differently in its upper and lower portions. In the upper portion, ledges or the like 7 are provided in the embodiment according to FIG. 1, while the lower portion of the circular cylindrical surface 3 is substantially smooth, thus free of projections.

The material fed via the feeder wedge 8 positioned between the opposing cylindrical surfaces 3 is first precomminuted by the ledges 7 and then crushed during the downward movement of the two tools 1 to the required particle size, whereupon it drops into a silo (not represented). The material not yet crushed to the required particle size is returned upwards by the two tools during their upward motion, loosened and shifted and again subjected to the action of the ledges 7 before it is conveyed downwards again during the subsequent downward motion of the tools. By this, the degree of comminution as compared to a known rolling crusher is essentially improved.

One of the two axles 4 can be arranged displaceably in relation to the respective other axle in one direction (double arrow 9) so that the distance between the two circular cylindrical surfaces 3 can be changed by this. This makes it possible not only to adjust this distance to the respective materials to be treated and to the required particle size, but also to change it temporarily, also by means of computer control, in order to let harder material inclusions or foreign matter pass the gap between the tools and thus prevent damage to the device. This makes it possible in many cases to do without elaborate magnetic separators or detector means above the material feeder belts.

At least one of the tools can be movably supported about its axle 4 in axial direction, so that this tool moves in axial direction in addition to its rotating movement about the axle 4. This causes a sort of grinding effect and improves the processing of the material.

The ledges 7 can be releasably attached to the surfaces 3 so as to facilitate their replacement in case of wear.

Figure 2:
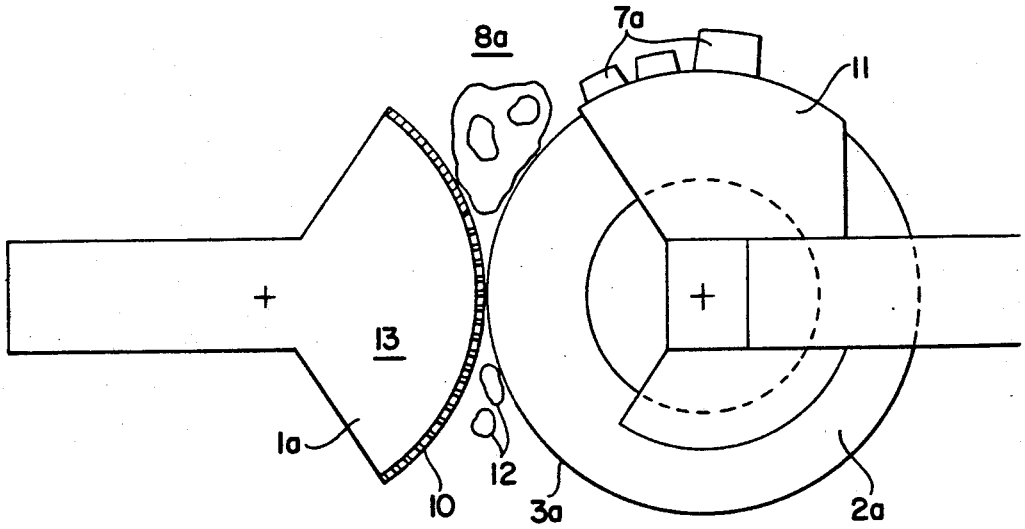
FIG. 2 is a corresponding representation of a device according to the invention used for the filtering of clay materials and FIG. 3 used for the sifting of moist materials.

In the embodiment according to FIG. 2, perforated filter plate 10 is provided on the lower portion of the surface of the tool 1*a*. The tool 2*a* consists of an elastically yielding material, for instance of solid rubber, or a vehicle tire filled with compressed air. A part of the surface 3*a* of this tool 2*a*, which does not come into contact with the filter plate 10, is formed rigidly and consists, for instance, of a metal jacket 11 of approximately U-shaped cross section surrounding the solid rubber ring or vehicle tire and carrying the projecting ledges 7*a*. These ledges 7*a* serve for the precomminution of clods of clay, lumps of ice, rocks and the like contained in the clay material introduced via the feeder wedge 8*a* to the extent that such a precomminution is possible. The clay material is subsequently forced through the filter plate by the elastically yielding surface 3*a* of the tool 2*a*. Those components of the clay material which cannot pass the perforations of the filter plate 10, i.e. rocks and other foreign matter 12, are conveyed downwards and thus discharged as a result of the elastically yielding configuration of the surface 3*a* of the tool 2*a*. The tool 2*a* can carry out an upward and downward pendulum motion but also a rotating motion about the bearing axle thereof.

The clay passing the orifices of the filter plate 10 is conveyed to a space 13 in the tool 1 behind the filter plate from where it is discharged.

Figure 3:
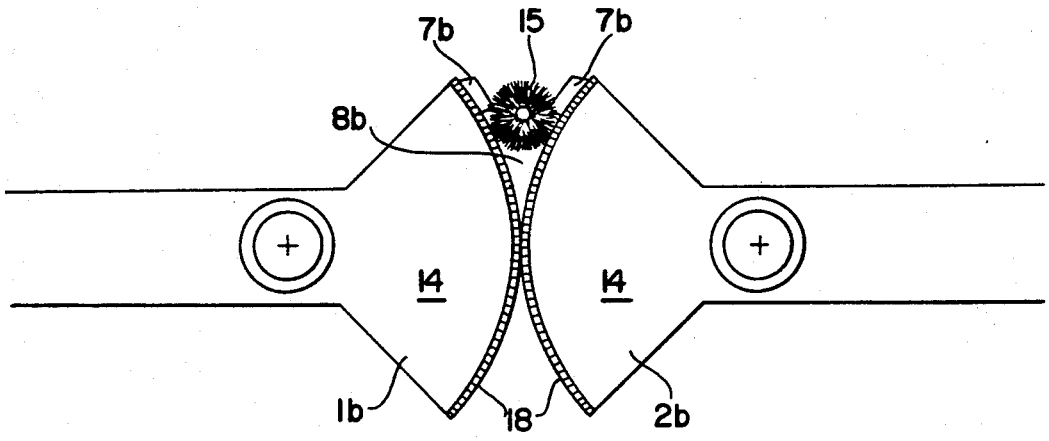

FIG. 3 shows a device for shifting a bulk material with a certain moisture content. In this device, the lower portion of the circular cylindrical surface 3*b* of the two tools 1*b*, 2*b* is provided with a screen 18. The bulk material introduced via the feeder wedge 8*b* is sifted through the screen 18 into the space 14 behind it, conglomerates, depending on their hardness, are either crushed by the ledges 7*b* and pass the perforations of the screen 18 or are comminuted in the lower roller gap adjusted narrowly before they pass the screen 18.

It is also possible to provide a screen 18 merely on one of the surfaces of the two tools and to form the surface of the other tool without screen perforations.

By the projecting ledges 7*b* also provided in this embodiment, the lumps forming due to the moisture content of the bulk material are also crushed before the bulk material is forced through the perforations of the screen.

It is convenient to provide for at least one of the screens to be heated in order to prevent clogging of the openings by the bulk material with moisture content. The same purpose is served by a cleaning brush 15 disposed in the feeder wedge 8 and cooperating with the screens whose perforations it keeps clear by rotating or oscillating.

Figure 4:
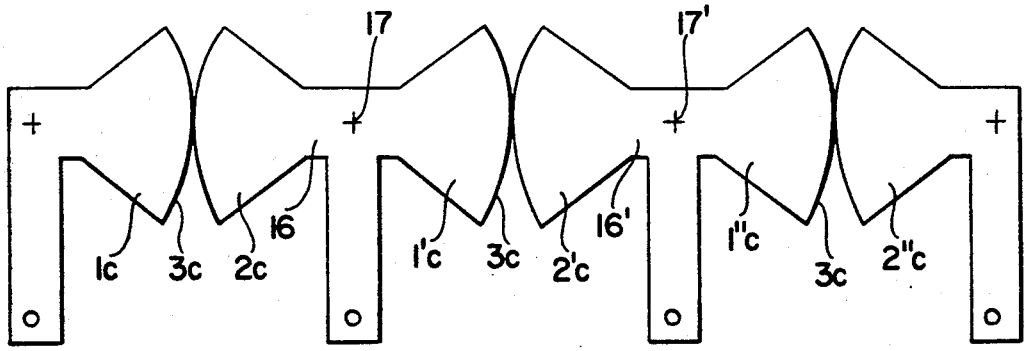
FIG. 4 shows a modified embodiment of a device according to the invention having three pairs of tools.

In the embodiment according to FIG. 4, a plurality of tools 1*c*, 2*c*, 1*c*′, 2*c*′, 1*c*″, 2*c*″ cooperating in pairs is provided. Two each tools 2*c*, 1*c*′ or 2*c*′, 1*c*″ of adjacent pairs are interconnected via an arm 16 or 16′ supported on a substantially horizontal axle 17 or 17′ disposed in the coinciding circular arc center of the surfaces 3*c* of the circular cylindrical cross section of these tools.

The drawing shows three pairs of tools, although it would be possible to provide merely two pairs of tools or more than three pairs of tools.

Also feasible is an embodiment in which two tools are interconnected via an arm, but only one counter tool cooperates with one of these tools. This embodiment has the advantage that replacement of the wearing parts is considerably simplified, as these are freely accessible on each tool connected to the arm which does not cooperate with a counter tool. Subsequent to replacement of the wearing parts, the arm is rotated by 180 degrees so that now the tool provided with the replaced wearing parts cooperated with the counter tool.

I claim:

1. A device for processing materials by comminuting, filtering, sifting, or grading, said materials including rock, ore, clay, bulk materials and agglomerated pulverized materials, said device comprising two tools, each of said tools having a central axis and having a working surface, means mounting each of said tools for rotation about the respective central axis thereof, said tools being oriented such that the working surfaces thereof are in opposed, horizontally spaced relation and cooperate to form a nip therebetween, means for moving at least one of said tools with an oscillating rotational motion about the respective central axis thereof, said tools cooperating to form a feeder wedge for receiving material to be processed between the working surfaces thereof, said feeder wedge merging into said nip, the working surfaces of said tools including upper and lower surface portions, comminuting projection means including at least one comminuting projection formed in the upper surface portion of said at least one tool, the lower surface portions of said tools each substantially defining a segment of a cylinder and each being coaxially oriented with respect to the central axis thereof, said lower surface portions of said tools being substantially smooth and being disposed in opposed closely spaced relation during movement of said tools, said nip being of substantially constant dimension during rotation of said tools.

2. The device of claim 1, further comprising a filter plate having a plurality of orifices therein on the lower surface portion of at least one of said tools.

3. The device of claim 1, further comprising a screen on the lower surface portion of at least one of said tools.

4. The device of claim 3, further comprising cleaning brush means in said feeder wedge for cleaning said screen.

5. In the device of claims 1, 2, 3, or 4, the lower surface portion of one of said tools being resiliently yieldable.

6. In the device of claim 5, said one tool having said resiliently yieldable lower surface portion comprising a yieldable inflated tube.

7. In the device of claim 1, said projection means being releasably attached to said at least one tool.

8. In the device of claim 1, the positions of said projection means being adjustable relative to the upper portion of the working surface of said at least one tool.

9. In the device of claim 1, the positions of said projection means being changeable relative to the upper portion of the working surface of said at least one tool.

10. In the device of claim 1, each of said tools including replaceable means defining the respective working surface thereof.

11. In the device of claim 1, said means for moving said at least one tool with an oscillating rotational motion only moving a single one of said tools, said device further comprising means for rotating the other one of said two tools.

12. In the device of claim 1, said means mounting said tools for rotation about the respective axes thereof further characterized as mounting one of said tools so that it is also movable in the direction of the respective central axis thereof.

13. In the device of claim 1, said means mounting said tools for rotation about the respective central axes thereof further characterized as mounting one of said tools so that it is displaceable relative to the other one of said tools for adjusting the spacing between said two tools.

14. The device of claims 1, 12, or 13, further comprising computer means, and sensing means for sensing the pressure between said two tools, said computer means being responsive to said sensing means for controlling the spacing between said two tools, the relative velocities of said two tools, the rhythm of said two tools, and the distance covered by said two tools in the same or opposing directions.

15. The device of claims 1, 12, or 13, further comprising computer means, and sensing means for sensing the power required to drive said two tools, said computer means being responsive to said sensing means for controlling the spacing between said two tools, the relative velocities of said two tools, the rhythm of said two tools, and the distance covered by said two tools in the same or opposing directions.

16. In the device of claim 1, at least one of said two tools being heated.

17. The device of claim 1, further comprising a plurality of adjacent pairs of said tools, two tools of two adjacent pairs of tools being interconnected via an arm which is supported on a substantially horizontal axle, the central axes of the two tools connected by said arm being co-axial with said axle.

* * * * *